US005769535A

United States Patent [19]

Rominger et al.

[11] Patent Number: 5,769,535

[45] Date of Patent: Jun. 23, 1998

[54] PORTABLE LAMP HAVING MULTIPLE BRIGHTNESS PROJECTION

[76] Inventors: Donnie R. Rominger; Lucille L. Rominger, both of 501 Carroll Rd., Kelso, Wash. 98626

[21] Appl. No.: 412,010

[22] Filed: Aug. 14, 1995

[51] Int. Cl.[6] ..... F21L 15/18

[52] U.S. Cl. ..... 362/396; 362/293; 362/343; 362/360; 362/398

[58] Field of Search ..... 362/396, 398, 362/362, 351, 186, 360, 230, 231, 293, 343

[56] References Cited

U.S. PATENT DOCUMENTS 3,755,668 8/1973 Moreschini ..... 362/396
4,262,327 4/1981 Kovacik et al. ..... 362/396
5,453,920 9/1995 Eubanks ..... 362/186
5,467,261 11/1995 Whetstone ..... 362/396

*Primary Examiner*—Alan Cariaso
*Attorney, Agent, or Firm*—William A. Birdwell & Associates

[57] ABSTRACT

A portable light lamp having multiple brightness providing predominantly directed light projection. The portable light employs a light source and a light source housing, the light source housing having a directed light port disposed to project light from the light source therethrough in a selected direction at a first brightness and at least one filtered light port to project light from the light source therethrough in another direction at a second brightness which is diminished from the first brightness. One or more magnets are secured to the side of the light source housing to attach the portable light to magnetic material.

12 Claims, 2 Drawing Sheets

PORTABLE LAMP HAVING MULTIPLE BRIGHTNESS PROJECTION

This invention relates to portable light sources, and relates particularly to providing a portable light source which projects a relatively bright light toward a work area of interest while at the same time projecting a muted light of lower intensity light into a surrounding area.

The invention relates to the repair industry and the need for light in the repair of various types of equipment, installation of components in hard to reach/see places, inspection of moving parts and the hundreds of other uses for a light that is portable. This invention assists the people who are technicians, mechanics, laborers, assembly persons, plumbers, electricians, builders, etc. by providing a light source that is much more efficient and effective.

BACKGROUND OF THE INVENTION

Accordingly, there is a need for a novel portable lamp having multiple brightness projection that provides for relatively intense illumination of a work area of interest while at the same time providing for softer illumination of the surrounding area.

Specialists the world over, be they laborers, technicians, mechanics, plumbers, etc. struggle with the light source when they are presented with an area or situation that requires moveable light and that supplies the light required. For the most part this requirement is satisfied by the light bulb on an electrical cord or by a drop-cord.

The traditional drop-cord or variation of same utilizes a standard 12 or 14 gauge wire cord, an electrical socket for the light-bulb and a wire cage to protect the light-bulb. This unit provides light that is modestly reflected off the solid back of the protective cage, but is very difficult to position as it requires the user to adapt to the light that is projected 360 degrees from its source—the light-bulb. When the user is required to adapt to the brightness of the light continually it generally wears on the productivity of the person as well as creating problems with their sight. The adapting that is required comes from the need for the user to look at other areas to locate parts or pieces that are required in the task being performed. This activity is difficult due to the brightness of the light which is projected in all directions from the source and the requirement required.

SUMMARY OF THE PRESENT INVENTION

The portable lamp having multiple brightness projection of the present invention solves the aforementioned problems and meets the aforementioned needs by employing a light source and a portable light source housing for containing, protecting and powering the light source, the light source housing having a front portion and a back portion and a direct light port in the front portion disposed to direct light from the light source therethrough in a first direction at a first brightness and at least one filtering light port in the back disposed to project light from the light source therethrough in a second direction at a second brightness which is diminished from the first brightness. Preferably, the direct light port includes an aperture for projecting the light directly out of the light source housing. Preferably, the filtering light port includes a light filter, for projecting the light out of the light source housing at a diminished light intensity. The light source housing includes means for attaching the light source housing to a suitable member at a work site. Preferably, the means for attaching the light source housing comprises a rotatable hook disposed at a top portion of the light source housing. Preferably, the means for attaching the light source housing also comprises magnetic strips attached thereto, to permit the light source housing to be conveniently attached to magnetic materials. Preferably, the light source is a standard incandescent light bulb.

Therefore, it is a principal object of the present invention to provide a novel and improved portable lamp.

It is another object of the present invention to provide such a portable lamp providing for multiple brightness projection.

It is a further object of the present invention to provide such a portable lamp which employs a standard, single filament, incandescent bulb to provide multiple brightness projection.

It is yet another object of the present invention to provide such a portable lamp which may be readily attached to convenient magnetic material.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
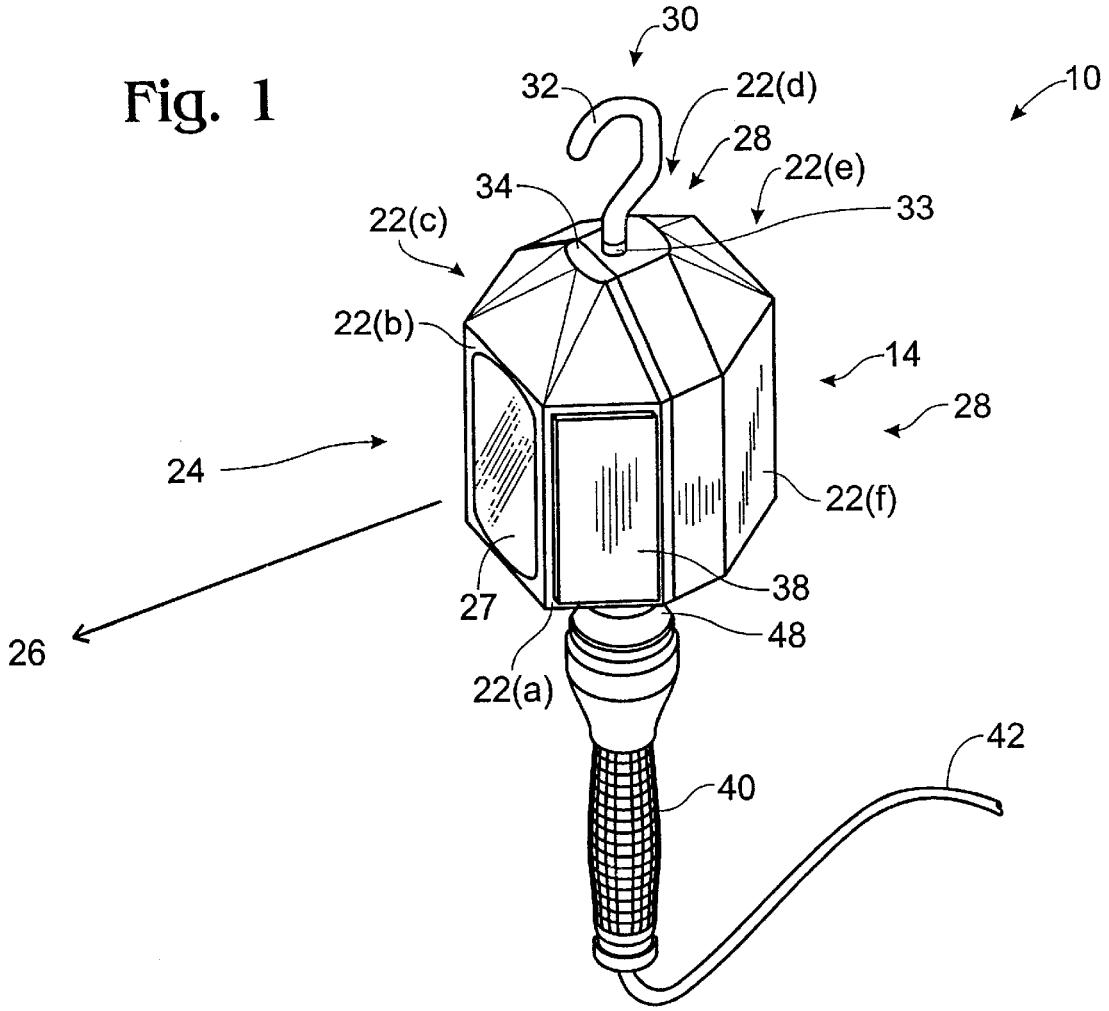
FIG. 1 is a pictorial view of a portable lamp having multiple brightness projection according to the present invention.
Figure 3:
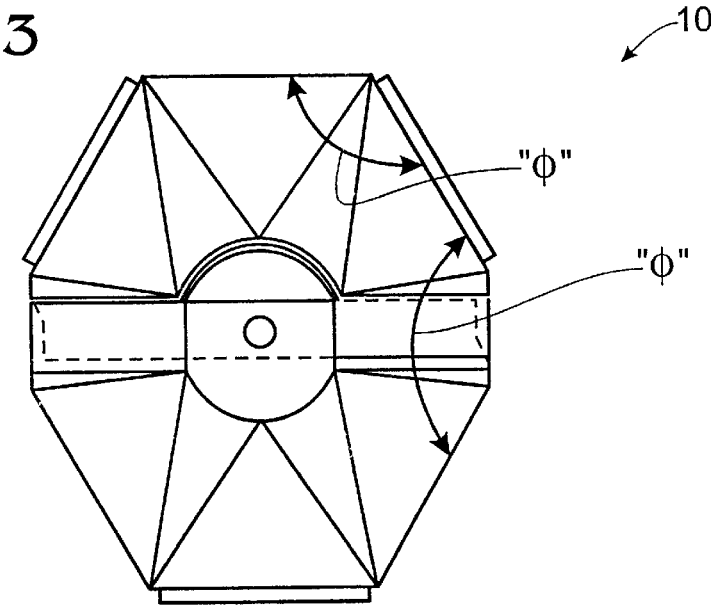
FIG. 3 is a plan view of the portable lamp of FIG. 1.
Figure 2B:
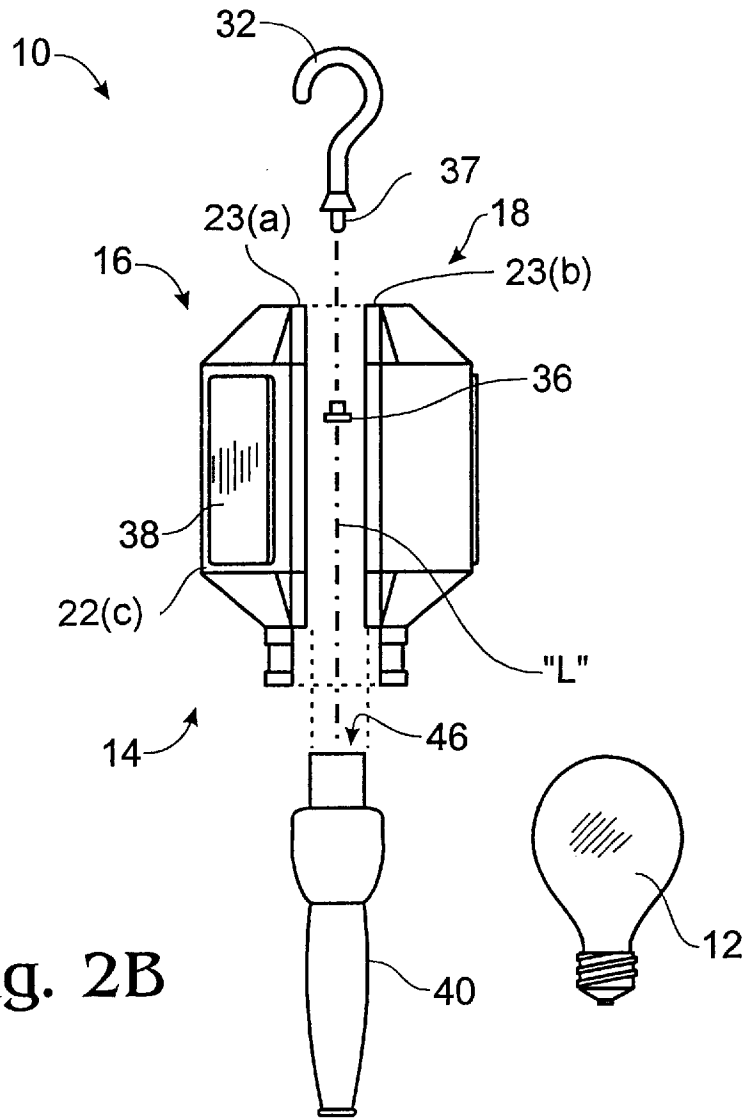
FIG. 2B is an exploded view of the side elevation of FIG. 2A.
Figure 2A:
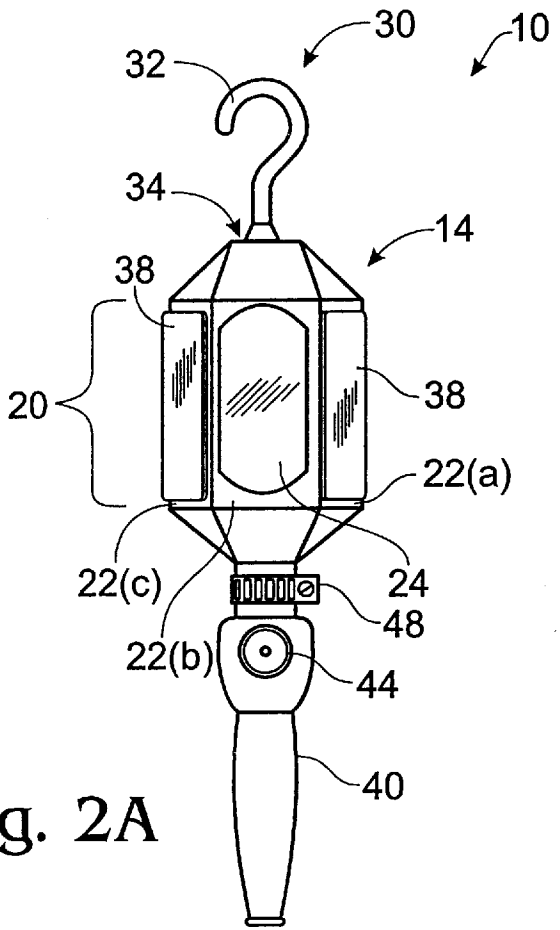
FIG. 2A is a side elevation of the portable lamp of FIG. 1.

Referring to FIGS. 1, 2A and 2B, a preferred embodiment of a portable lamp 10 having multiple brightness projection includes a light source 12. The light source 12 is preferably a standard incandescent light bulb.

The lamp 10 also includes a light source housing 14 for containing, protecting and powering the light source 12. The light source housing has a longitudinal axis "L" and a midportion 20, the cross-section of the housing 14 at the mid-portion 20 preferably being substantially hexagonal and having hexagonal panels 22(*a*)–22(*f*) which lie substantially parallel to the axis "L", adjacent panels forming respective obtuse interior angles $\phi$. The angle $\phi$ between any two adjacent panels may differ from the angle $\phi$ between any other two adjacent panels without departing from the principles of the invention.

The light source housing 14 has generally a front portion 16 and a back portion 18, the front and back portions dividing the housing 14 into substantially bilaterally symmetric halves. The front and back portions preferably employ interlocking flanges 23A and 23B for snapping the front and back portions together, along with an adjustable clamp as described below.

The front portion 16 of the housing 14 includes a direct light port 24. The direct light port is preferably an aperture 25 to permit light to pass from the light source 12 therethrough, to project the light in a first direction 26 out of the housing 14. Preferably, the aperture 25 has a translucent cover 27, so that the intensity of the light projected therethrough is substantially undiminished by the housing 14 in the first direction 26. The aperture 25 is selected in size to provide a substantially focused beam of light along the direction 26, for brightly illuminating a relatively small work area of interest.

The back portion 18 includes a filtering light port 28. The filtering light port 28 is preferably formed by the material of which the back portion 18 is formed, the material being selected to filter the light from the light source 12, to provide a soft-muted light therefrom that, by illuminating the areas surrounding an area in which it is desired to provide a relatively intense or bright light, allows the user to work more effectively and with reduced eye strain by making it easier for the eyes to adjust between identifying and locating needed items out of the stream of the relatively intense light projected through the aperture 25 and returning thereto. Materials, preferably light weight materials such as partially reflecting and portably transmissive plastic, so providing the aforementioned characteristics will be readily apparent to those of ordinary skill in the art.

It is believed that both the front portion 16 and the back portion 18 act to intensify the light emitted from the direct light port 24 and the filtering light port 28, due to the reflective qualities of the interior of the front portion 16 and the back portion 18.

The light source housing 14 includes means 30 for attaching the light source housing to a suitable member at a work site. Preferably, the means 30 comprises a rotatable hook 32 disposed in a hole 33 which, preferably, overlaps the front portion 16 and the back portion 18 of the housing 14, at a top portion 34 thereof. A plastic fastening nut 36 may be employed to a distal end of a threaded shank 37 of the hook 32 to permit rotation of the hook.

Preferably, the means 30 also comprises a plurality of magnetic strips 38 attached to panels of the front portion 16 and back portion 18, to permit the light source housing 14 to be conveniently attached to magnetic materials. The front portion 16 of the housing 14 preferably includes two panels 22(*a*), 22(*b*) to which respective magnetic strips 38 are affixed. Preferably the back portion 18 of the housing includes one panel 22(*e*) to which a respective magnetic strip 38 is attached, which permits two panels 22(*d*), 22(*e*) to function as the filtering light port 28.

The lamp 10 includes a pre-manufactured handle 40 carrying a power cord 42, a switch 44 electrically connected to the power cord, and a light socket 46 adapted to receive the light source 12. To assemble the lamp, the front portion 14 and back portion 16 of the housing are clamped to the handle with an adjustable clamp 48.

One of the ordinary skill, after reading the foregoing description of the drawings provided herein, will be able to effect the various other changes, alterations and substitutions of equivalents without departing from the broad concepts disclosed. It is therefore intended that the scope of the patent granted hereon be limited only by the definition contained in the appended claims and the equivalents thereof as reflected in the drawings.

We claim:

1. A portable lamp, comprising:

a front light cover, having panels to affix magnets thereon, an opening to provide a focused beam of light, a first locking flange and a first hole disposed at the top of said front light cover to attach a hook;

a back light cover, having panels to affix magnets thereon and a second hole disposed at the top of said back light cover to attach a hook;

a hook, said hook having a threaded portion for placement in said first hole and said second hole; and a nut for attaching said hook to said front light cover and said back light cover, said nut having internal threads matching said threaded portion of said hook, said front light cover and said back light cover being made of plastic that reflects light through said opening while allowing some light to radiate through said plastic.

2. A drop light, comprising:

a handle having a first end and a second end, an electrical light socket disposed at said first end of said handle for receiving a light bulb, a power cord extending from said second end for providing electricity to the light bulb a front light cover disposed at said first end of said handle for positioning over the front half of the light bulb and the passage of light therethrough, a back light cover disposed at said first end of said handle and coupled to said front light cover, said back light cover having a plurality of panels disposed at obtuse interior angles to one another, a hook attached to at lest one of said back light cover and front light cover opposite said first end of said handle, at least one magnet secured to at least one said panel of said back light cover for allowing said drop light to be attached to magnetic material, wherein said front light cover has a plurality of panels disposed at obtuse interior angles to one another, and said drop light further comprises at least one magnet secured to at least one said panel of said front light cover for allowing said drop light to be attached to magnetic material wherein one of said panels of said front light cover comprises a direct light port to permit light to pass therethrough in a selected direction, wherein at least one of said front light cover and said back light cover comprises plastic that reflects light through said direct light port while allowing some light to radiate through said plastic.

3. A portable work lamp, comprising:

a lamp housing adapted for enclosing a light source, said housing having a top, a bottom and a side wall;

a first light port disposed in said side wall of said lamp housing and adapted to project a majority of the light from said light source predominately therethrough in a selected direction;

a filtered light port disposed in said side wall of said lamp housing and adapted to filter the remaining available light from said light source and transmit the filtered light therethrough in another direction; and a magnet secured to said side wall of said lamp housing for attaching said lamp housing to magnetic material.

4. The portable lamp of claim 3, said light source having a brightness, wherein said majority of the light is projected through said direct light port at a first brightness, wherein said first brightness is substantially said brightness of said light source.

5. The portable lamp of claim 1, wherein said first light port comprises an aperture through said light housing.

6. The portable of claim 5, wherein said aperture is selected in size to provide a substantially focused beam of light along said first direction, for brightly illuminating a relatively small work area of interest.

7. The portable lamp of claim 3, further comprising a handle, disposed at said bottom of said lamp housing.

8. The portable lamp of claim 3, further comprising a hook disposed at said top of said lamp housing.

9. The portable lamp of claim 3, wherein said second light port comprises a light filter attached to said housing.

10. The portable of claim 9, wherein said light filter is integral with said housing.

11. The portable lamp of claim 9, wherein said light filter is disposed so as to project a soft-muted light toward said other direction, for softly illuminating a relatively wide area surrounding a work area which is to be brightly illuminated with said first light port.

12. The portable lamp of claim 11, wherein said lamp housing comprised a partially reflective and partially transmissive material, said light filter comprising said side wall of said housing.

* * * * *